US006074053A

United States Patent [19]

Kawaura

[11] Patent Number: 6,074,053

[45] Date of Patent: Jun. 13, 2000

[54] PRINTER WITH REDUCED EJECTED PRINTED PAPER AREA

[75] Inventor: Masafumi Kawaura, Nagoya, Japan

[73] Assignee: Brother Kogyo Kabushiki Kaisha, Nagoya, Japan

[21] Appl. No.: 08/746,622

[22] Filed: Nov. 12, 1996

[30] Foreign Application Priority Data

Nov. 20, 1995 [JP] Japan ..... 7-326401

[51] Int. Cl.[7] ..... B41J 2/01

[52] U.S. Cl. ..... 347/104

[58] Field of Search ..... 347/104, 101, 347/108; 271/8.1, 3.14, 278; 355/308, 321, 322, 323; 400/605, 623, 624, 632

[56] References Cited

U.S. PATENT DOCUMENTS 5,560,726 10/1996 Kawaguchi ..... 400/641
5,603,493 2/1997 Kelly ..... 271/188

FOREIGN PATENT DOCUMENTS 57-178779 11/1982 Japan .

OTHER PUBLICATIONS

LaserJet 4L HP laserJet 4L Printer User's Manual, p. 2–6, 1993.

*Primary Examiner*—John Barlow
*Assistant Examiner*—Michael S. Brooke
*Attorney, Agent, or Firm*—Oliff & Berridge, PLC

[57] ABSTRACT

In a printer of which the installation area is significantly reduced, a paper roller, a pressure roller, an eject roller, and a spur roller carry printing paper at an angle of T to a horizontal plane. A stacker for storing the printed paper horizontally therein includes a fixed stacker base formed by part of a housing bottom wall and an auxiliary stacker that can be pushed in and pulled out from under the stacker base. This design shortens a horizontal distance between the paper feed roller and the eject roller, forms the stacker base under a printing mechanism sufficiently long, and shortens the auxiliary stacker in the stacker. Consequently, the total length of the printer with the auxiliary stacker fully extended can be reduced, and the entire auxiliary stacker can be accommodated under the printer.

29 Claims, 3 Drawing Sheets

PRINTER WITH REDUCED EJECTED PRINTED PAPER AREA

BACKGROUND OF THE INVENTION

1. Field of the Invention

The invention relates to a printer for reducing an area for accommodating ejected printing paper.

2. Description of Related Art

An ink jet printer as shown FIG. 3 is known. In the conventional printer 210, an ink jet head 251 is oriented such that a print face 254 thereof is parallel to an accommodating surface 278 of a stacker 270 for accommodating printed paper.

Printing paper 12 loaded in a paper supply cassette 214 is carried by a paper supply roller 216 between a paper feed roller 231 and a pressure roller 232 onto a printing guide 235. Then, when the paper 12 is fed to a predetermined printing position, the paper feed roller 231 stops. Subsequently, a carriage 252 with the ink jet head 251 mounted thereon is reciprocated along a guide shaft 253 by a carriage drive motor, not shown, while the ink jet head 251 discharges ink from a nozzle thereof onto the printing paper 12 for printing.

Then, when printing of a predetermined width has been completed, the paper feed roller 231 is rotated to feed the printing paper 12 to the next printing position. Meanwhile, a leading edge 122 of the printed paper 12 is ejected from between a paper eject roller 260 and a spur roller 261. When printing has been completed and a trailing edge 121 of the printing paper 12 is released from the held state between the paper eject roller 260 and the spur roller 261, the printing paper is accommodated on the top surface 278 of the stacker 270.

The stacker 270 is composed of a fixed stacker base 271 arranged in a housing 224 and an auxiliary stacker 272 that can be pushed in and pulled out relative to a stacker accommodating space 274 provided under a bottom wall 273 of the housing. An abutting member 275 that abuts against the leading edge of the ejected printing paper 12 is located at B of FIG. 3 when the auxiliary stacker 272 is fully drawn out and at A when the same is fully pushed in. In the figure, L1 denotes the full length of the accommodated printing paper 12, namely the full length of the accommodating surface.

However, as shown in FIG. 3, the conventional printer 210 has a total length L9, which is a length L7 obtained by adding the total length L1 of the stacker 270 to a length L2 from the paper feed roller 231 to the paper eject roller 260, plus a length from the paper supply cassette 214 to the paper feed roller 231. In addition, because there is little internal mechanism portion exposed outward from the paper eject roller 231, the fixed stacker base 271 is relatively short and the movable auxiliary stacker 272 is relatively long with respect to the total.

Consequently, when the printer is not in use and it is attempted to accommodate the auxiliary stacker 272, the abutting member 275 projects out from under the lower portion of the housing 224 to prevent the auxiliary stacker 272 from being fully accommodated, thereby making the printer installation area relatively large. In addition, when the auxiliary stacker 272 is fully drawn out, the printer installation area becomes even relatively larger because the drawn-out length of the stacker is relatively great. These problems are especially conspicuous when the printer is used in cramped places, such as on a desk top.

SUMMARY OF THE INVENTION

It is therefore an object of the present invention to solve the above-mentioned problems by providing a printer that occupies relatively less area when in use and out of use.

In carrying out the invention and according to one aspect thereof, there is provided a printer comprising a carrying device for carrying printing paper tilted toward a printer installation surface. A printing mechanism opposed to the printing paper for printing and an accommodating device for accommodating the printing paper printed by the printing mechanism are also provided. The accommodating device is arranged at a predetermined angle less than 90° to a paper carrying direction by the carrying device. An end of the accommodating device toward the carrying device is arranged under the printing mechanism, and at least one portion of the accommodating device is arranged such that the same can be pushed in and pulled out from under the printing mechanism.

In the printer according to the present invention having the above-mentioned constitution, the accommodating device for accommodating the printed paper is arranged to form a predetermined angle less than 90° to the carrying direction of the carrying device. So, as compared with a design having no such angle, the position at which the trailing edge of the printed paper is released from the carrying means can be set nearer the printing mechanism, shortening the distance between a print head and a paper eject roller.

Moreover, because the end of the accommodating device toward the carrying means device is located under the printing mechanism, the trailing edge of the printed paper can be accommodated under the printing mechanism. Consequently, the displacement of the accommodating device projecting from the printer in use can be reduced by the degree to which the rear end of the accommodating device toward the carrying device is under the printing mechanism.

Further, because at least one portion of the accommodating device is arranged such that the same can be pushed in and pulled out from under the printing mechanism, the area to be occupied by the printer when the accommodating device is not used can be reduced. Thus, the printer according to the present invention occupies a reduced area, both in and out of use.

Still further, in the printer according to the present invention, the rear end of the accommodating device toward the carrying device is formed by a fixed wall under the printing mechanism and the portion of the accommodating device that can be pushed in and pulled out is slidably arranged under that fixed wall. Consequently, the length of the portion that can be pushed in and pulled out can be reduced. At the same time, simply sliding the accommodating device can push in and pull out that portion.

Yet further, in the printer according to the present invention, the fixed wall is a portion of the bottom wall of a housing that accommodates the carrying device and the printing mechanism and is arranged generally horizontally. Consequently, the accommodating device can be pushed in and pulled out along the bottom wall of the housing generally horizontally. In other words, the printed paper can be set in the accommodating device generally horizontally.

In addition, the printer according to the present invention is designed such that the predetermined angle between the bottom of the accommodating device and the carrying direction by the carrying device is about 46 to 60°.

Consequently, as compared with a constitution in which this angle does not exceeds 45°, the accommodating position of the trailing edge of the printing paper can be moved nearer the printing mechanism. At the same time, the ejected printing paper can be accommodated in the accommodating device such that the printing paper is not bent extremely.

As described above according to the present invention, the area occupied by the printer can be reduced both in use and out of use. Moreover, the accommodating device for accommodating the printed paper can be stored in the bottom of the printer, thereby preventing dust and other undesirable matter from being accumulated thereon.

BRIEF DESCRIPTION OF THE DRAWINGS

Preferred embodiments of the invention will be described in detail with reference to the following figures wherein.

DESCRIPTION OF PREFERRED EMBODIMENTS

Figure 1:
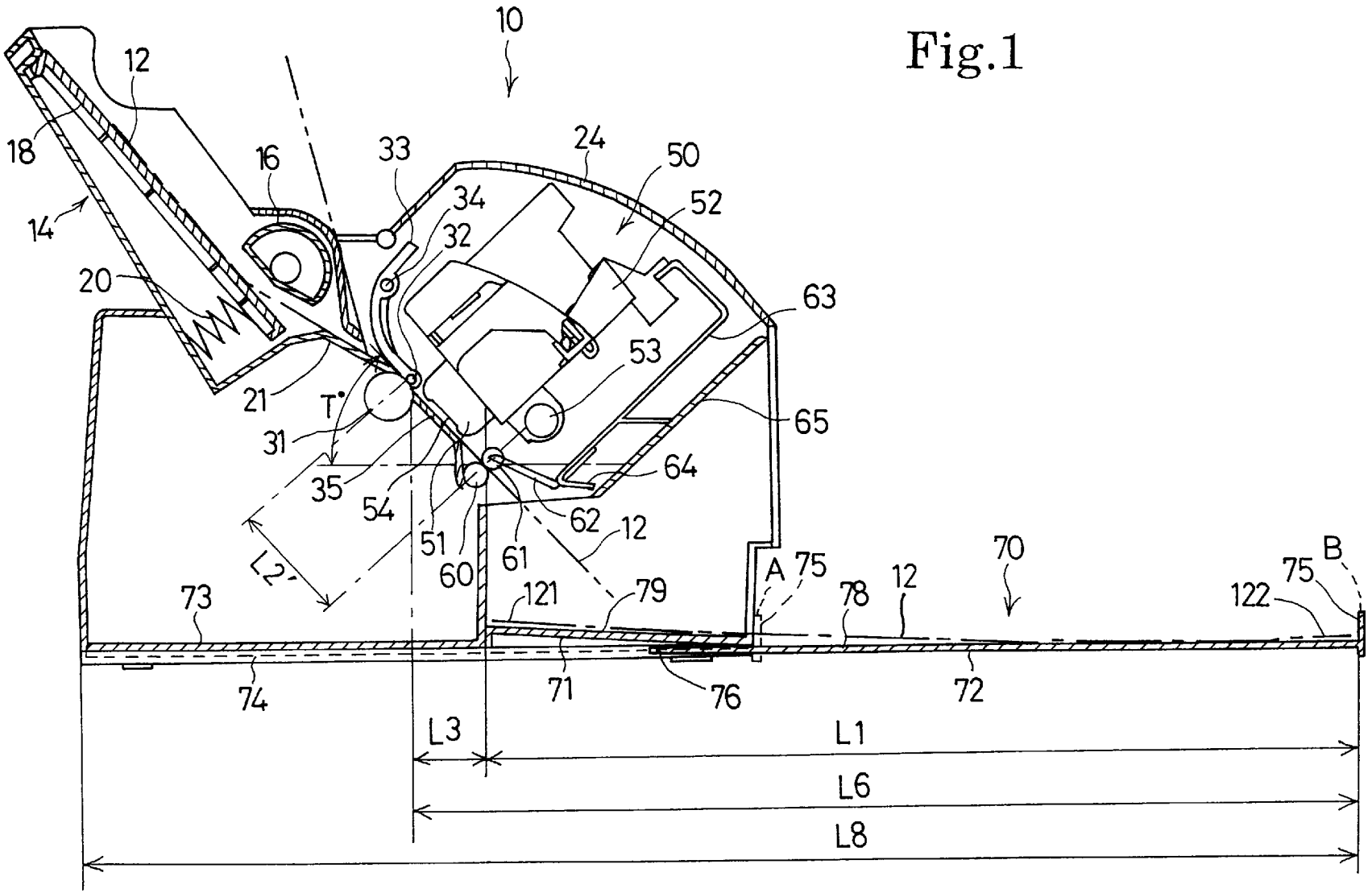
FIG. 1 is a longitudinal cross sectional view illustrating the main internal mechanisms of a printer practiced as one preferred embodiment of the present invention.
Figure 2:
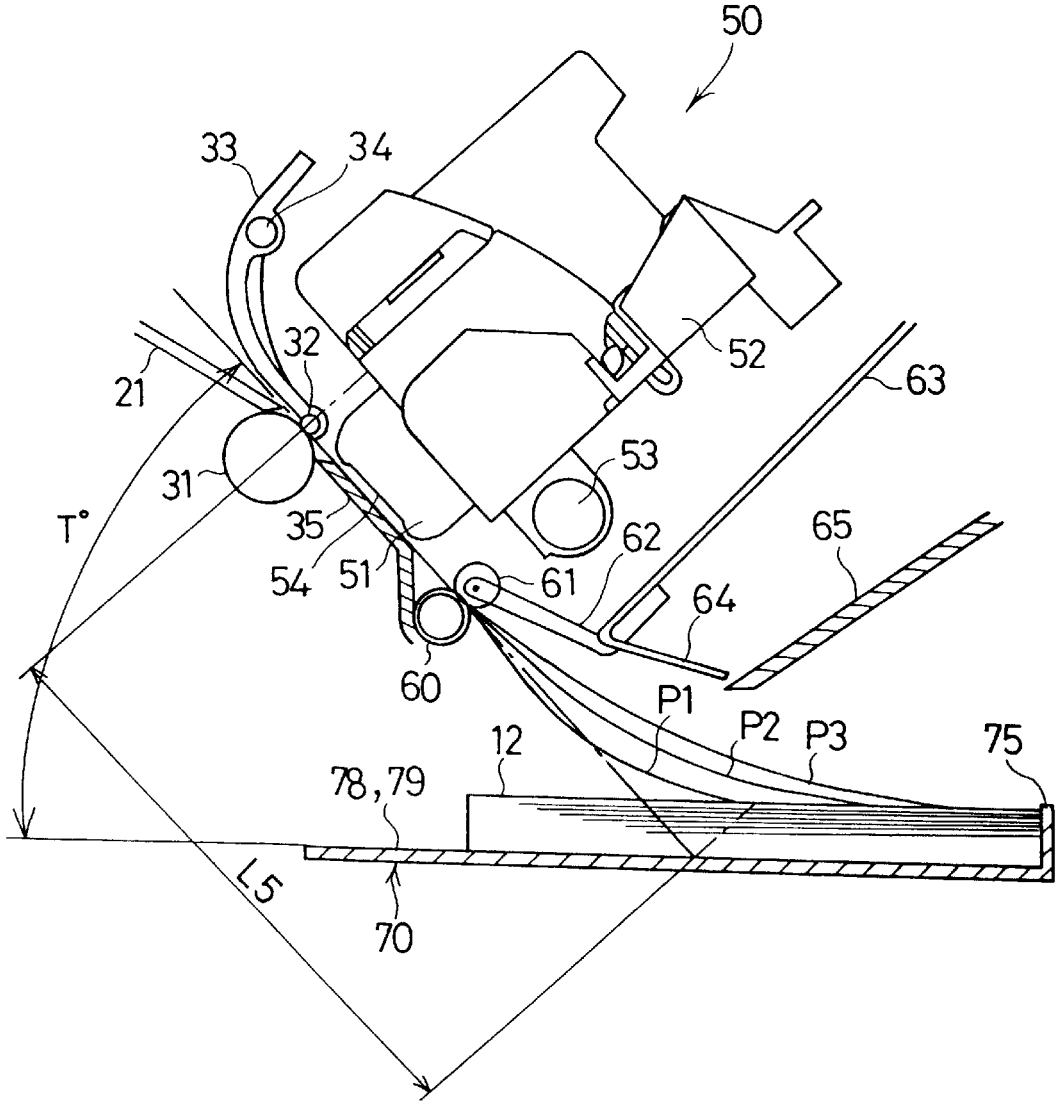
FIG. 2 is a longitudinal enlarged cross sectional view illustrating paper feeding, printing, ejecting and accommodating mechanisms of the printer of FIG. 1.

Referring to FIG. 1, a longitudinal cross sectional view illustrates the main internal mechanisms of an ink jet printer (hereinafter simply referred to as a printer) practiced as one preferred embodiment of the present invention. FIG. 2 shows an enlarged cross sectional view illustrating paper feeding, printing, ejecting and accommodating mechanisms of the printer of FIG. 1. In FIGS. 1 and 2, the left side indicates the rear of the printer while the right side indicates the front of the printer.

As shown in FIG. 1, the printer 10 is provided at the rear side thereof with a paper supply cassette 14, which is capable of accommodating a plurality of sheets of printing paper 12. A paper supply roller 16 having a rotary shaft along the width of the printing paper 12 is arranged at a lower front position of the paper supply cassette 14 in contact with the uppermost sheet of printing paper 12. The paper supply cassette 14 is internally provided with a tray 18 on which the printing paper 12 is stacked. The tray 18 is pressed against the paper supply roller 16 by a coil spring 20. Namely, the printing paper 12 stacked on the tray 18 touches the surface of the paper supply roller 16 by the pressing force of the coil spring 20 to be carried by the motor-driven paper supply roller 16 downward on a guide 21.

A carrying mechanism (i.e., a transport device) on the paper supply side composed of a motor-driven paper feed roller 31 and a pressure roller 32 having a rotary shaft parallel to that of the paper feed roller 31 is provided in a housing 24 at a diagonally lower front position (i.e., an initial transport point) of the paper supply roller 16. This pressure roller 32 is rotatably pivoted on a roller holder 33, which is swingably pivoted on a mounting shaft 34 and, at the same time, pressed by a pressing mechanism, not shown, in the swing direction (clockwise in the figure). Namely, the pressing force in the swing direction presses the pressure roller 32 onto the paper feed roller 31.

Then, the printing paper 12 carried along the guide 21 by the paper supply roller 16 is fed between the paper feed roller 31 and the pressure roller 32 onto a printing guide 35 provided at a lower front position (printing position).

In the housing 24, a print unit 50 is provided that has an ink jet head 51 having a print face 54 opposite to the top of the printing guide 35. The printing guide 35 is arranged at an angle of T (=47°) to the printer installation surface (namely, the horizontal plane). To be specific, the printing guide 35 is arranged such that the ejected printing paper 12 is led into a stacker 70 at an angle of 47°. The ink jet head 51 is internally formed with a plurality of ink chambers each attached with a piezoelectric device. When voltage is applied to the piezoelectric device, the volume of the ink chamber is varied to discharge ink from a nozzle formed on the ink chamber onto the surface of the printing paper 12 held on the printing guide 35.

The ink jet head 51 is mounted on a carriage 52 mounted on a guide shaft 53 provided in the width direction in the printer. The carriage 52 is reciprocated by a carriage drive motor, not shown, along the guide shaft 53 to make the ink jet head 51 print on the printing paper 12 along the width thereof.

Under the ink jet head 51, a carrying mechanism (i.e., a discharge device) on the eject side is provided that is composed of a motor-driven eject roller 60 and a spur roller 61 between which the printed paper 12 is fed for ejection (i.e., at a discharge point). The spur roller 61 is made of a thin material with the external periphery thereof formed with a plurality of sharp projections. To be specific, ink deposited on the surface of the printing paper 12 is still wet and, if a rubber roller, for example, having a large contact area is used as with a non-ink jet printer, the ink will be smeared. This is one reason that the spur roller 61, which has a small contact area, is used.

The spur roller 61 is pivotally supported by a plate-shaped spur roller holder 62 mounted on a frame 63 that supports the carriage 52. A bent flange 64 is formed on the top end of the frame 63. The bent flange 64 and the spur roller holder 62 form a generally continuous surface. Under the frame 63, a partition plate 65 is formed extending from the rear side of the housing 24, generally in parallel to the frame 63. The top end of the partition plate 65 is located near the top end of the bent flange 64.

Namely, the spur roller holder 62, the bent flange 64 and the partition plate 65 form a wall that covers the rear top surface of the stacker 70, thereby preventing dust or other undesirable matter from falling onto the upper surface of the printed paper 12.

A passage of the printing paper 12 formed by the carrying mechanism 31, 32 on the paper supply side and the carrying mechanism 60, 61 on the eject side tilts down in the carrying direction of the printing paper 12 at an angle of T. Under the carrying mechanism 60, 61 on the eject side, an accommodating mechanism, namely the stacker 70, is arranged generally horizontally with a step. The stacker 70 is composed of a stacker base 71 under the spur roller holder 62. The bent flange 64 and the partition plate 65 and an auxiliary stacker 72 extend in front of the stacker base 71. The stacker base 71, which is part of a bottom wall 73 of the housing 24, is formed as a fixed wall that tilts slightly downward in the eject direction of the printing paper 12. The auxiliary stacker 72 is arranged under the stacker base 71 such that the auxiliary stacker 72 can be slidably pushed in and pulled out relative to a stacker accommodating space 74 provided under the bottom wall 73 of the housing 24. The auxiliary stacker 72 is formed at the front end thereof into a plate-shaped abutting member or leading edge 75, which abuts the leading edge of the ejected printing paper 12 to accommodate the plurality of printed paper in alignment. The auxiliary stacker 72 is formed on the rear thereof with a stopper 76 that prevents the auxiliary stacker 72 from being pulled off the housing.

Figure 3:
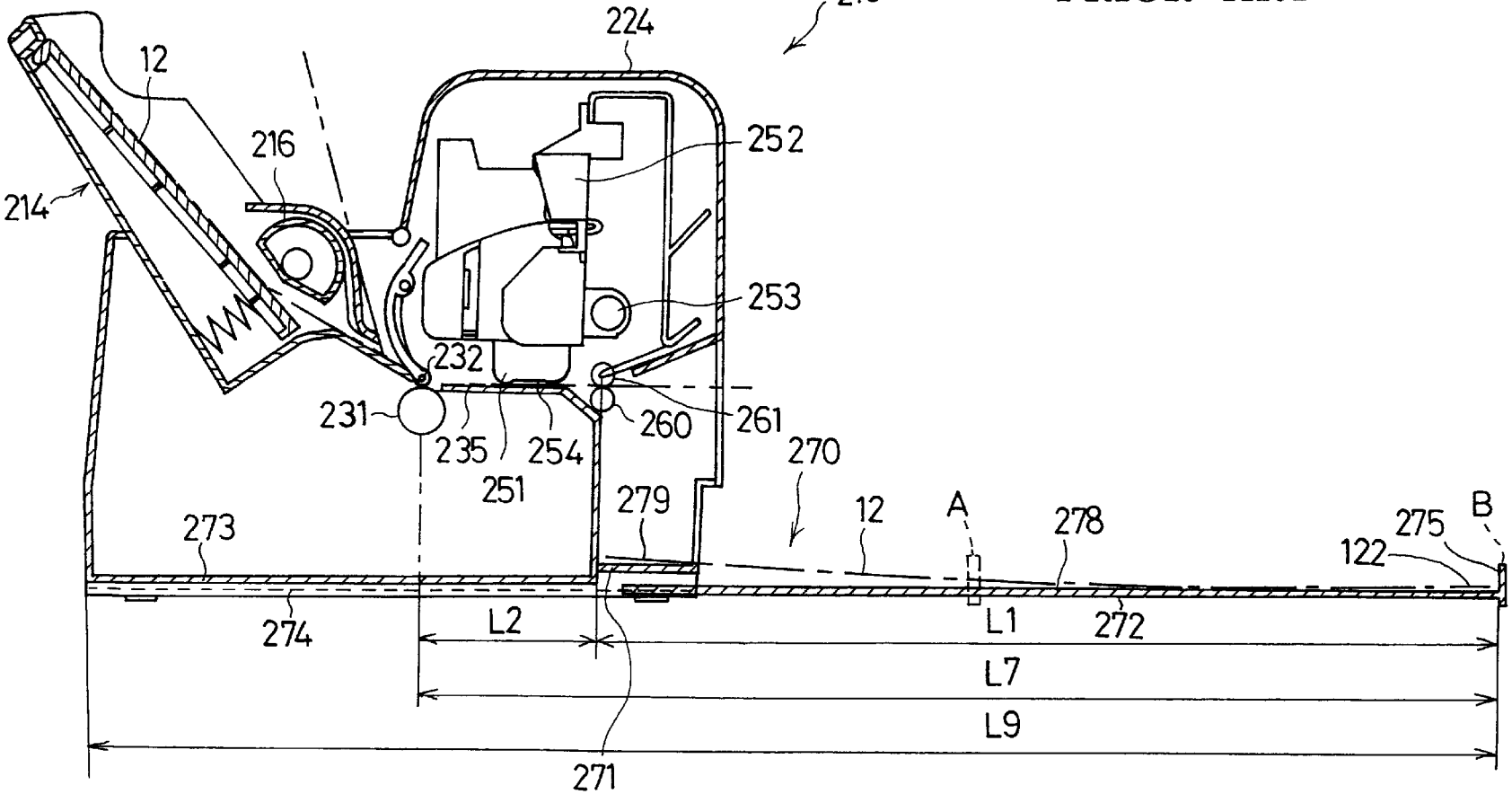
Fig.3 PRIOR ART
FIG. 3 is a longitudinal cross sectional view illustrating the main internal mechanisms of a prior art printer.

The following makes a comparison between the areas occupied by the printer 10 according to the present invention and the conventional printer 210 of FIG. 3.

In the comparison, the distance required for accommodating the printing paper 12, namely the total length of a top surface 79 (279) of the stacker base 71 (271) and a top surface 78 (278) of the auxiliary stacker 72 (272), is L1. The total length of the printer 10 and the conventional printer 210 with the auxiliary stacker 72 (272) fully drawn out are L8 and L9, respectively.

First, a comparison is made between a horizontal distance L3 between the paper feed roller 31 and the eject roller 60 of the invention and the conventional distance L2 measured likewise. As shown in FIG. 1, since L3=L2' cosT (L2=L2'), if 0<T <90, then L3<L2.

Namely, a length obtained by adding the total length L1 of the stacker 70 to L3 and L2 is L6 and L7, respectively. Assuming that a distance from the paper supply cassette 14 to the paper feed roller 31 is the same for both the constitutions, then the printer 10 according to the present invention is shorter in the total length than the conventional printer 210 by L7−L6=L2−L3=(L2−L2 cosT)=L2 (1−cosT).

Consequently, the total length L8 of the printer 10 in use can be made shorter than L9 of the conventional printer 210 by this amount. Thus, the area occupied by the printer 10 as compared with the conventional printer is reduced.

As pointed out herein in the Description of Related Art, the conventional printer 210 has a longer auxiliary stacker 272. Consequently, when the auxiliary stacker 272 is to be stored in the stacker accommodating space 274, the auxiliary stacker 272 cannot be fully stored in the stacker accommodating space 274 because the stacker accommodating space 274 is shorter than the auxiliary stacker 272, thereby projecting to A as shown in FIG. 3. With the printer according to the present invention, the printing mechanisms such as the ink jet head 51 and the carriage 52 are tilted, so that the portion extending forward from the eject roller 60 gets larger. Thereby, the length of the stacker base 71 located below the extended portion can be extended. As a result, the auxiliary stacker 72 can be shortened to be fully stored in the stacker accommodating space 74 as shown in FIG. 1.

Consequently, according to the printer 10, the area occupied by the printer out of use can also be reduced. Further, the auxiliary stacker 72 can be stored in the bottom of the printer 10, thereby preventing dust and other undesired matter from being accumulated on the auxiliary stacker 72.

It is apparent that, as the angle T approaches 90° over 45°, the value of L3 gets smaller. Therefore, the area occupied by the printer can be reduced by reducing the projection of the auxiliary stacker 72. However, this makes greater the angle at which the ejected printing paper 12 goes into the auxiliary stacker 72 greater, thereby preventing the printing paper from being smoothly ejected. It is therefore desirable to set the angle T to about 46 to about 60°.

As shown in FIG. 2, in the present embodiment, a distance L5 from the contact point (the holding point of the printing paper 12) between the paper feed roller 31 and the pressure roller 32 through the contact point between the eject roller 60 and the spur roller 61 to the top surface 78 of the auxiliary stacker 72 is set to a value not more than the width of a smallest printable paper, for example, a postcard. So, the leading edge 122 of the printing paper 12 is in contact with the top surface 79 of the stacker base 71 when the trailing edge 121 of the printing paper 12 is released from the paper feed roller 31 and the pressure roller 32. Also, the auxiliary stacker 72 is arranged at a height such that the printing paper on the top of a full-stack of paper does not come in contact with the top end of the partition plate 65.

The following describes the process in which the printing paper 12 is supplied, printed, and ejected in the printer 10 having the above-mentioned constitution.

First, the printing paper 12 stored in the paper supply cassette 14 is carried by the paper supply roller 16 that rotates counterclockwise to the paper feed roller 31 along the guide 21. Then, the printing paper 12 carried along the guide 21 is fed between the paper feed roller 31 that rotates clockwise and the pressure roller 32 that rotates counterclockwise to be carried toward the print face 54 along the printing guide 35.

When the printing paper 12 reaches the print face 54, the paper feed roller 31 stops rotating, upon which the ink jet head 51 is driven to discharge ink onto the printing paper 12 for printing while being moved by the carriage 52. Then, when printing for one line has come to an end, the paper feed roller 31 starts rotating to feed the printing paper 12 to the next printing position at which generally the same printing operation as mentioned above is performed. Subsequently, generally the same printing and paper feeding are repeated to eject the printing paper 12 between the eject roller 60 and the spur roller 61 into the stacker 72.

If, when the trailing edge 121 of the printing paper 12 is released from the held state by the paper feed roller 31 and the pressure roller 32, the leading edge 122 of the printing paper 12 is not abutting the top surface 79 of the stacker base 71 and therefore is in a suspended state, the printing paper 12 droops by its own weight, bending around the eject roller 60. This bending flips up the trailing edge 121 of the printing paper 12 toward the print face 54 of the ink jet head 51.

However, in the printer 10, when the trailing edge 121 of the printing paper 12 is released from the paper feed roller 31 and the pressure roller 32, the leading edge 122 of the ejected printing paper 12 has already been abutting the top surface 79 of the stacker base 71. So, the printing paper 12 can be easily bent upward as shown by P1 of FIG. 2.

Then, as paper feeding progresses, the printing paper 12 is ejected toward the abutting member 75 while gradually decreasing the degree (angle) of the bend as shown by P2 and P3 of FIG. 2. The printing paper is released from the eject roller 60 and the spur roller 61 to be stacked on the top surface 79 of the stacker base 71 and the top surface 78 of the auxiliary stacker 72.

Namely, the trailing edge 121 of the printing paper 12 is kept pressed toward the printing guide 35 after being released from the paper feed roller 31 and the pressure roller 32. So, the trailing edge does not flip up toward the print face 54 when released.

Consequently, the above-mentioned novel design prevents the trailing edge 121 of the printing paper 12 from coming in contact with the print face 54, causing no ink smear on the printing paper. This design also prevents the nozzle of the ink jet head 51 from being clogged with dust or fiber detached from the printing paper 12.

While the preferred embodiment of the present invention has been described using specific terms, such description is for illustrative purposes only, and it is to be understood that changes and variations may be made without departing from the spirit or scope of the appended claims. For example, the present embodiment is applicable to wire dot printers and thermal printers in addition to ink jet printers.

What is claimed is:

1. An ink jet printer comprising:

a paper supply that supplies and feeds paper for printing an image thereon;

a housing into which the paper is fed;

a paper feeding assembly disposed within the housing that transports paper along a feed path, which is tilted with respect to a generally horizontal support surface, from the paper supply through the ink jet printer, wherein the paper feeding assembly includes a transport device with an initial transport point, which is disposed adjacent to the paper supply, and a discharge device with a discharge point;

a print unit disposed along the feed path within the housing between the transport device and the discharge device that jets ink onto the paper for printing an image thereon; and a stacker disposed at an angle to the feed path downstream and vertically spaced from the discharge device, the feed path being tilted toward the stacker, the stacker having an end and a surface that can receive and accumulate a stack of paper discharged from the paper feeding assembly that has an image printed thereon, wherein the discharged paper is curved with an upward concavity with respect to the stacker before the discharged paper is released from the discharge device so that the discharged paper with ink jetted thereon does not contact and become smeared by the print unit, and wherein the stacker comprises an auxiliary stacker that extends from the ink jet printer and fully retracts within a footprint of the housing.

2. The ink jet printer of claim 1 wherein the paper feeding assembly and print unit are tilted at an angle of greater than 0° and less than or equal to 90° with respect to the generally horizontal support surface and the surface of the stacker.

3. The inkjet printer of claim 1 wherein the paper feeding assembly and print unit are tilted at an angle of between 45° and 90° with respect to the generally horizontal support surface and the surface of the stacker.

4. The ink jet printer of claim 1 wherein the paper feeding assembly and print unit are tilted at an angle of between 46° and 60° with respect to the generally horizontal support surface and the surface of the stacker.

5. The ink jet printer of claim 1 wherein the paper feeding assembly and print unit are tilted at an angle of 47° with respect to the generally horizontal support surface and the surface of the stacker.

6. The ink jet printer of claim 1 wherein the stacker includes a fixed base portion and wherein the discharged paper is accommodated on the base and the extended portion of the auxiliary stacker.

7. The ink jet printer of claim 6 wherein the base is tilted with respect to the generally horizontal support surface at a lesser degree than the feed path.

8. The ink jet printer of claim 1 wherein the auxiliary stacker has a rear stopper that engages the housing to prevent full withdrawal of the auxiliary stacker.

9. The ink jet printer of claim 1 wherein the housing has a fixed wall that is spaced above and extends over at least a portion of the stacker.

10. The ink jet printer of claim 1 wherein the print unit is an ink jet head for discharging ink droplets onto the paper for printing.

11. The ink jet printer of claim 1 wherein the housing has a recess formed on a bottom side thereof in which the auxiliary stacker is accommodated.

12. The ink jet printer according to claim 1, wherein the stacker has a leading edge extending from the surface adapted to abut a leading edge of the discharged paper.

13. The ink jet printer of claim 1, wherein the auxiliary stacker is slidable.

14. The ink jet printer of claim 1, wherein the auxiliary stacker extends from the ink jet printer to a size that fully accommodates a length of discharged paper substantially parallel to the horizontal support surface.

15. The ink jet printer of claim 1 wherein the stacker is positioned such that a leading end of the discharged paper abuts the stacker when a trailing end of the discharged paper is released from the transport device.

16. The ink jet printer of claim 1 wherein the feed path declines toward the stacker and the generally horizontal support surface.

17. An ink jet printer supported on a generally horizontal surface comprising:

a paper supply including a tray that supports a plurality of sheets of paper and a paper supply mechanism that feeds paper from the tray;

a paper feeding mechanism positioned downstream of the paper supply that feeds paper in a feeding direction along a feed path at an angle to the surface on which the ink jet printer is supported, the paper feeding mechanism including a paper feed roller and a pressure roller that position and feed the paper and form an initial transport point;

a printing guide located immediately adjacent to the paper feeding mechanism;

an ink jet printing mechanism disposed at an angle to the surface on which the ink jet printer is supported opposed from the printing guide that ejects ink onto paper supported by the printing guide;

an ejection mechanism including a driving ejection roller and an opposed spur roller that define a discharge point, wherein the spur roller minimally contacts the printed paper to prevent smearing;

a housing that surrounds the paper feeding mechanism, the ink jet printing mechanism and the ejection mechanism; and a stacker adjacent to and vertically stepped down from the ejection mechanism that can receive a stack of discharged paper, the feeding direction being tilted toward the stacker, wherein the stacker is generally parallel to the horizontal surface supporting the ink jet printer and wherein the discharged paper is curved with an upward concavity with respect to the stacker before the discharged paper is released from the ejection mechanism to prevent a trailing end of the discharged paper from contacting the ink jet printing mechanism.

18. The ink jet printer of claim 17 further comprising an auxiliary stacker positionable in an extended position and a retracted position fully accommodated within a footprint of the housing.

19. The ink jet printer of claim 17 wherein the stacker has a base fully accommodated within a footprint of the housing.

20. The ink jet printer of claim 19 wherein the base is tilted with respect to the surface that supports the ink jet printer.

21. The ink jet printer of claim 17 wherein the paper feeding direction and ink jet printing mechanism are disposed at an angle between 46° and 90° to the stacker and the surface that supports the ink jet printer.

22. The ink jet printer of claim 17 wherein the paper feeding direction and ink jet printing mechanism are disposed at an angle of about 47° to the stacker and the surface that supports the ink jet printer.

23. The ink jet printer of claim 17, wherein the stacker includes a base and a retractable auxiliary stacker with an end that in combination support an entire length of discharged paper, the retractable auxiliary stacker being generally parallel to the surface that supports the ink jet printer.

24. The ink jet printer of claim 17, wherein the tray in the paper supply has a height that accommodates a stack of paper, and the stacker has a height, which accommodates a stack of paper between the ejection mechanism and vertically stepped down stacker, that is generally equal to or greater than the height of the tray.

25. The ink jet printer of claim 17 wherein the stacker is positioned such that a leading end of the discharged paper abuts the stacker when a trailing end of the discharged paper is released from the paper feeding mechanism.

26. The ink jet printer of claim 17 wherein the feed path declines toward the stacker and the generally horizontal surface that supports the ink jet printer.

27. The ink jet printer of claim 1, wherein the end of the stacker is positioned a first linear distance L1 from a line extending from the discharge point perpendicular to the surface of the stacker, and wherein a second linear distance L2 is measured along the feed path from the initial transport point through the discharge point to a point at which a line coextensive with the feed path intersects the surface of the stacker, the first linear distance L1 being greater than or equal to the second distance L2.

28. The ink jet printer of claim 17, wherein the stacker has an end that is positioned a first linear distance L1 from a line extending from the discharge point perpendicular to the surface of the stacker, and wherein a second linear distance L2 is measured along the feed path from the initial transport point through the discharge point to a point at which a line coextensive with the feed path intersects the surface of the stacker, the first linear distance L1 being greater than or equal to the second distance L2.

29. An ink jet printer supported on a generally horizontal surface comprising:

a paper supply including a tray that supports a plurality of sheets of paper and a paper supply mechanism that feeds paper from the tray;

a paper feeding mechanism positioned downstream of the paper supply that feeds paper in a feeding direction along a feed path disposed at an angle to the horizontal surface such that the feed path declines toward the horizontal surface on which the ink jet printer is supported, the paper feeding mechanism including a paper feed roller and a pressure roller that position and feed the paper and form an initial transport point;

a printing guide located immediately adjacent to the paper feeding mechanism;

an ink jet printing mechanism disposed at an angle to the surface on which the ink jet printer is supported opposed from the printing guide that ejects ink onto paper supported by the printing guide;

an ejection mechanism including a driving ejection roller and an opposed spur roller that define a discharge point, wherein the spur roller minimally contacts the printed paper to prevent smearing;

a housing that surrounds the paper feeding mechanism, the ink jet printing mechanism and the ejection mechanism; and a stacker adjacent to and vertically stepped down from the ejection mechanism that can receive a stack of discharged paper and accommodate a full length of the discharged paper, the feeding direction being tilted toward the stacker, wherein the stacker is generally parallel to the horizontal surface supporting the ink jet printer and wherein the discharged paper is curved with an upward concavity with respect to the stacker before the discharged paer is released from the ejection mechanism to prevent a trailing end of the discharged paper from contacting the ink jet printing mechanism, and wherein the stacker is fully retractable within the housing.

* * * * *